US012043929B2

(12) United States Patent
Ellerhorst

(10) Patent No.: US 12,043,929 B2
(45) Date of Patent: Jul. 23, 2024

(54) KNITTED COMPONENT WITH INLAY PLUSH

(71) Applicant: NIKE, Inc., Beaverton, OR (US)

(72) Inventor: Martin Ellerhorst, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/900,823

(22) Filed: Aug. 31, 2022

(65) Prior Publication Data

US 2023/0064557 A1 Mar. 2, 2023

Related U.S. Application Data

(60) Provisional application No. 63/239,712, filed on Sep. 1, 2021.

(51) Int. Cl.
*D04B 1/02* (2006.01)
*A43B 1/04* (2022.01)
(Continued)

(52) U.S. Cl.
CPC ..... *D04B 1/02* (2013.01); *A43B 1/04* (2013.01); *D04B 1/102* (2013.01); *D04B 1/12* (2013.01);
(Continued)

(58) Field of Classification Search
CPC . D04B 1/24; D04B 1/02; D04B 1/102; D04B 1/12; D04B 1/025; A43B 1/04
(Continued)

(56) References Cited

U.S. PATENT DOCUMENTS 603,164 A * 4/1898 Baron et al. ..... D04B 23/08 66/191
2,279,919 A * 4/1942 Fleisher ..... D04B 9/12 66/191
(Continued)

FOREIGN PATENT DOCUMENTS

JP 2010-100982 A 5/2010
WO 2020/033813 A1 2/2020
(Continued)

OTHER PUBLICATIONS

Santoni X-Machine for 3D shoe uppers on show at ISPO, Knitting Industry; Available online at: <https://www.knittingindustry.com/santoni-xmachine-for-3d-shoe-uppers-on-show-at-ispo/>, Jan. 28, 2020, 2 pages.
(Continued)

*Primary Examiner* — Danny Worrell
(74) *Attorney, Agent, or Firm* — Shook, Hardy & Bacon L.L.P.

(57) ABSTRACT

A knitted component comprises plush loops created with an inlaid yarn. A first surface of the knitted component includes a first yarn formed with a first stitch sequence that includes a quantity of knit stitches and a quantity of missed stitches. The second surface includes a second yarn formed with a second stitch sequence that includes a quantity of tuck stitches and a quantity of missed stitches. A third yarn is inlaid between two needle beds knitting the first and second yarns, and while the third yarn is inlaid, tuck stitches of the second yarn created with the previous pass of the carriage are transferred from one needle bed to another. Loops formed by the third yarn are locked into place by the transferred tuck stitches. The knitted component may be incorporated into an article of footwear. A method of manufacturing the knitted component is also described herein.

20 Claims, 7 Drawing Sheets

(51) Int. Cl.
*D04B 1/10* (2006.01)
*D04B 1/12* (2006.01)
*D04B 1/24* (2006.01)

(52) U.S. Cl.
CPC ..... *D04B 1/24* (2013.01); *D10B 2501/043* (2013.01)

(58) Field of Classification Search
USPC ..... 66/190, 191, 194
See application file for complete search history.

(56) References Cited

U.S. PATENT DOCUMENTS 2,774,233 A * 12/1956 Lombardi ..... D04B 15/06 66/194
3,111,829 A * 11/1963 Artzt ..... D04B 1/02 66/194
3,796,067 A 3/1974 East
4,520,636 A 6/1985 Schnegg
4,567,075 A 1/1986 Krawczyk
4,712,281 A 12/1987 Scheller
4,787,219 A 11/1988 Sato et al.
4,805,424 A 2/1989 Charkovsky et al.
4,845,960 A 7/1989 Schnegg
4,998,419 A 3/1991 Moore
5,016,450 A * 5/1991 Pernick ..... D04B 1/02 66/93
5,186,025 A * 2/1993 Neher ..... D04B 9/26 66/194
5,429,555 A 7/1995 Beckh
6,125,662 A * 10/2000 Bizer ..... D04B 9/12 66/194
11,365,494 B2 * 6/2022 McFarland, II ..... D04B 1/123
2015/0315728 A1 11/2015 Yang
2017/0273363 A1 9/2017 Patchin et al.
2020/0048800 A1 * 2/2020 McFarland, II ..... D04B 1/123
2021/0148017 A1 * 5/2021 Baranek ..... D04B 1/16
2022/0275544 A1 * 9/2022 McFarland, II ..... D04B 1/123

FOREIGN PATENT DOCUMENTS

WO 2020/133617 A1 7/2020
WO 2021/101979 A1 5/2021

OTHER PUBLICATIONS

Bruer, M.S. , "Three Dimensionally Knot Spacer Fabrics: A Review of Production Techniques and Applications", NCSU College of Textiles, vol. 4, Issue 4, Summer2005, 31 pages.
Ishmael, N. , "Textile Technologies for the Manufacture of Three-Dimensional Textile Preforms", Research Journal of Textile and Apparel, vol. 21 No. 4, 2017, Emerald Publishing Limited, 2017, pp. 342-362.
International Search Report and Written Opinion received for PCT Patent Application No. PCT/US2022/042347, mailed on Dec. 9, 2022, 14 pages.

* cited by examiner

KNITTED COMPONENT WITH INLAY PLUSH

CROSS-REFERENCE TO RELATED APPLICATIONS

This non-provisional patent application claims priority to U.S. provisional patent app. No. 63/239,712, filed on Sep. 1, 2021, and titled "Knitted Component with Inlay Plush," the entire contents of which is incorporated herein by reference.

TECHNICAL FIELD

Aspects herein relate to knitted components and methods of manufacturing knitted components for use in articles, such as articles of footwear.

BACKGROUND

A variety of articles, including footwear, are formed from textiles, which are often formed by weaving or interloping (e.g., knitting) a yarn or plurality of yarns, usually through a mechanical process. In particular, an upper for an article of footwear may be formed of a knit textile. An upper typically forms a void within the article of footwear for comfortably and securely receiving a foot and is often secured to a sole structure.

Knitting generally includes one or more yarns being manipulated to form a plurality of intermeshed loops that define a variety of courses and wales. In weft knitting in particular, the courses and wales are perpendicular to each other and may be formed from a single yarn or multiple yarns. While knitting may be performed by hand, commercial manufacture of knit textiles is generally performed by knitting machines. Various knit structures may be achieved using the knitting machine. Some of these structures traditionally require the use of additional and/or specialized equipment. For instance, terry loops, which result in a plush texture for a textile, are conventionally created using an additional piece of equipment, sometimes referred to as plush equipment, which is added to a knitting machine. The use of an additional piece of equipment increases manufacturing costs and may limit other abilities of the machine, such as transfers of yarn. As a result, patterning and running time may also be increased when using this specialized plush equipment. Further, once the plush equipment is not needed, it would be removed, limiting the efficiency of using a knitting machine for different types of textiles.

BRIEF DESCRIPTION OF THE DRAWINGS

The knitted components, uppers, articles of footwear, and methods of manufacturing the same disclosed herein are discussed in detail in connection with the attached drawing figures, which depict non-limiting examples, in which.

DETAILED DESCRIPTION

Figure 1:
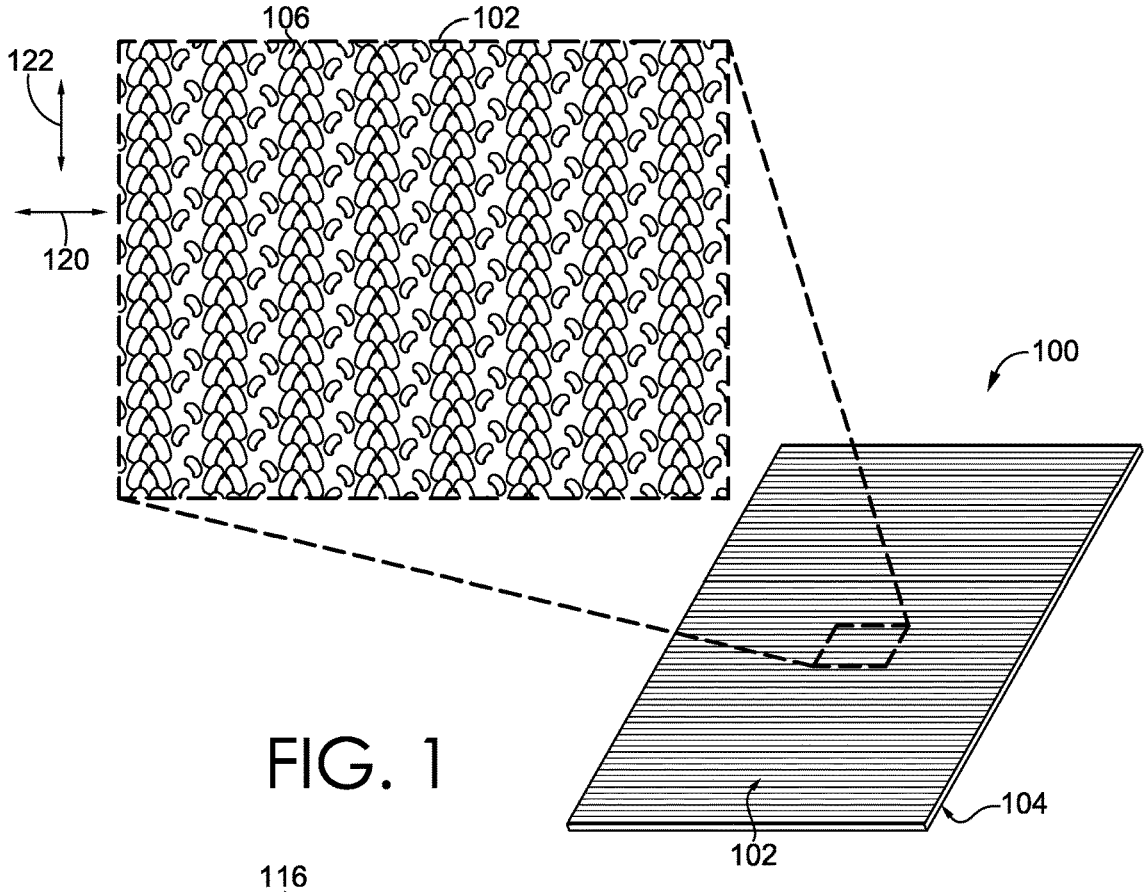
FIG. 1 depicts a first surface of a knitted component with a plush portion in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to identify different elements of methods employed, the terms should not be interpreted as implying any particular order among or between various steps herein disclosed unless and except when the order of individual steps is explicitly stated.

A variety of articles are formed from textiles. For example, articles of apparel (e.g., shirts, pants, socks, footwear, jackets, and other outerwear, briefs and other undergarments, hats and other headwear), containers (e.g., backpacks, bags), and upholstery for furniture (e.g., chairs, couches, car seats) are often at least partially formed from textiles. These textiles are often formed by weaving or knitting a yarn or plurality of yarns, usually through a mechanical process. One particular object that may be formed from a textile, such as a knit textile, is an upper for an article of footwear. An upper typically forms a void within the article of footwear for comfortably and securely receiving a foot and is often secured to a sole structure.

Knitting is an example process for forming a textile. Knitting may generally be classified as either weft knitting or warp knitting. In both weft knitting and warp knitting, one or more yarns are manipulated to form a plurality of intermeshed loops that define a variety of courses and wales. In weft knitting in particular, the courses and wales are perpendicular to each other and may be formed from a single yarn or multiple yarns. While knitting may be performed by hand, commercial manufacture of knit textiles is generally performed by knitting machines. An example knitting machine for producing weft knitted textile is a V-bed flat knitting machine, which includes two needle beds that are angled with respect to each other. Rails extend above and parallel to the needle beds and provide attachment points for feeders, which move along the needle beds and supply yarns to needles within the needle beds.

Various knit structures may be achieved using the knitting machine. Some of these structures traditionally require the use of additional and/or specialized equipment. For instance, terry loops, which may create a plush texture and/or moisture management properties for a textile, are conventionally created using an additional piece of equipment, sometimes referred to as plush equipment, which is added to the knitting machine. The use of an additional piece of equipment increases manufacturing cost and may limit other abilities of the machine, such as transfers of yarn. As a result, patterning and running time may be increased when using this specialized plush equipment. Further, once the plush equipment is not needed, it is necessary to remove it to avoid interfering with other types of knitting, limiting the efficiency of using a knitting machine for different types of textiles.

At a high level, various aspects of this disclosure are directed to a knitted component in which loops for plush texture are created for example from an inlaid yarn strand instead of from specialized plush equipment. The knitted component includes a first surface and an opposite second surface. Loops extend outward from the second surface, creating the plush texture. The knitted component includes courses including a first yarn and a second yarn, and each loop is formed with a third yarn that is inlaid within the courses. Within each course, the first yarn has a first stitch sequence that includes a quantity of knit stitches and a quantity of missed stitches forming at least part of the first surface. For example, the first yarn may have a stitch sequence of two knit stitches and one missed stitch. Additionally, within each course, the second yarn has a second stitch sequence, including a quantity of tuck stitches, forming at least part of the second surface. For instance, the second yarn may have a stitch sequence of one tuck stitch adjacent two missed stitches. Each tuck stitch is interloped with a knit stitch of the first yarn. The first and second stitch sequences are repeated at least once within each course. Additionally, each loop of the third yarn may extend between two tuck stitches of the second yarn. As explained further below, each tuck stitch may be transferred from one needle bed to another needle bed during the knitting process to effectively lock in place the loops formed by the third yarn. In some aspects, the first yarn may comprise a fusible material that is at least partially fused with the second yarn, which may also help lock in place the loops of the third yarn.

Some aspects of the present disclosure include an article at least partially formed of the knitted component with inlay plush. For example, an upper for an article of footwear may be formed with the knitted component such that the second surface, which has the outward extending loops of the third yarn, would form a surface of the upper. In an example aspect, the second surface forms an interior surface of the upper, creating a soft, plush feel against at least part of a wearer's foot. The inlay plush loops of the third yarn may provide cushioning as well as moisture management properties. Alternatively, the second surface of the knitted component may form an exterior surface of the upper, resulting in the plush texture being more visually accessible when the upper is being worn. In an another configuration, two layers of the inlay knitted component may be used to form the upper, where the second surface with the inlay loops of each layer may face outward such that inlay plush loops form an interior surface and an exterior surface of the upper.

Further aspects of the present disclosure include a method of manufacturing a knitted component with inlay plush. The method includes knitting a plurality of courses with a first yarn and a second yarn, and inlaying a third yarn between the first yarn and the second yarn within each course. Each course may be knit by knitting the first yarn on a first needle bed of a knitting machine using a first stitch sequence and knitting the second yarn on the second needle bed using a second stitch sequence. The first stitch sequence may be repeated at least once and include a quantity of knit stitches and a quantity of missed stitches. The second stitch sequence may be repeated at least once and include a quantity of tuck stitches and a quantity of missed stitches. The drawing in that occurs after knitted structures are released from the needles and/or removed from the knitting machine may force the inlaid third yarn to form loops extending outward from the second surface between two tuck stitches. Further, as the third yarn is inlaid during a pass of a carriage on the knitting machine, tuck stitches of the second yarn that were made in a previous pass of the carriage may be transferred from the second needle bed to the first needle bed. The transfer of the tuck stitches from the second needle bed to the first needle bed act to lock in place the loops of the third yarn formed between two tuck stitches. In this way, methods described herein may create plush loops, or closely-spaced loops extending outward from the surface of the knitted component, without the using specialized plush equipment on the knitting machine.

Additionally, in some aspects, adjacent courses may alternate between starting the second stitch sequence on a first needle of the second needle bed and on a second needle of the second needle bed. In this way, loops of the third yarn, which are locked between two tuck stitches, in adjacent courses may be offset from each other. This alternating configuration of the loops may help create more evenly spaced loops and uniform plush texture, rather than the loops being bunched together. The first stitch sequence may be started on the same needle in each course. In some aspects, the adjacent courses may start the second stitch sequence at the same needle position, e.g., with both courses starting at the first needle of the second needle bed or at the second needle of the second needle bed, and thus the loops of the third yarn may be substantially aligned in adjacent courses, in contemplated aspects.

In additional aspects, in adjacent courses, an offset of the loops can be provided through changing and/or alternating the number of knit stitches between missed stitches and/or between tuck stitches in a knit course. For example, in one knit course, a first stitch sequence formed using a first yarn may comprise two knit stitches followed by one or more missed stitches arranged in a repeating sequence, and in another knit course, e.g., an adjacent knit course, the first stitch sequence may be another number of knit stitches, e.g., one, three, four, or another number of knit stitches other than two, followed by one or more missed stitches, arranged similarly in a repeating sequence. As a result, the repeating sequence of knit stitches and missed stitches changes between courses, e.g., between adjacent courses. This configuration can also be used to provide the offset in the loops between the courses.

As described, certain aspects of the present disclosure relate to articles of footwear or aspects thereof that are at least partially formed from knit textiles. In an, illustrative example, aspects are directed to an upper formed at least partially of a knitted component. As used herein, the term "upper" refers to a footwear component that extends over the instep and toe areas of the foot, along the medial and lateral sides of the foot, and around the heel area of the foot to form a void for receiving a wearer's foot. Illustrative, non-limiting examples of uppers may include uppers incorporated into a basketball shoe, a biking shoe, a cross-training shoe, a global football (soccer) shoe, an American football shoe, a bowling shoe, a golf shoe, a hiking shoe, a ski or snowboarding boot, a tennis shoe, a running shoe, and a walking shoe. Further, in other aspects, the upper may also be incorporated into a non-athletic shoe, such as a dress shoe, a loafer, and a sandal. Accordingly, the concepts disclosed with respect to articles of footwear apply to a wide variety of footwear types.

Positional terms used when describing the upper, such as top, bottom, front, sides, back, superior, inferior, lateral, medial, right, left, interior, exterior, inner-facing, and outer-facing and the like, are used with respect to the upper being worn as intended with the wearer standing upright such that the wearer's foot is in the foot-receiving void and the wearer's ankle or leg extends through the ankle opening. It should be understood, however, that use of positional terms do not depend on the actual presence of a human being for interpretative purposes.

The term "knitted component" refers to a textile piece that is formed from at least one yarn that is manipulated (e.g., with a knitting machine) to form a plurality of intermeshed loops that define courses and wales. The term "course," as used herein, refers to a predominantly horizontal row of knit loops (in an upright textile as it is knit) that are produced by adjacent needles during the same knitting cycle. The course may comprise one or more stitch types, such as a knit stitch, a missed stitch, a tuck stitch, a transfer stitch, a rib stitch, and the like as these terms are known in the art of knitting. The term "knit stitch," as used herein, refers to the basic stitch type where the yarn is cleared from the needle after pulling a loop of the yarn from the back to the front of the textile through a previous stitch. The term "course-wise direction," as used herein, refers to a path extending substantially along, across, and/or through a predominately horizontal row of horizontal knit loops as described above. The term "wale," as used herein, is a predominantly vertical column of intermeshed or interlooped knit loops, generally produced by the same needle at successive (but not necessarily all) courses or knitting cycles. The term "wale-wise direction," as used herein, refers to a path extending substantially along, across, and/or through a predominately vertical column of intermeshed or interlooped knit loops as described above. The terms "inlaid" and "inlay," as used herein, and as pertaining to yarns, fibers, filaments, cords, cables, threads, and the like, refer to such elements being introduced into a knit structure so as to extend along, across, and/or through a course and/or a wale of the knit structure. The terms "horizontal" and "vertical" as used herein are relative to an upright textile as knit in which the heads of knit loops face toward the top of the textile and the course that is knit first is oriented towards the bottom of the textile.

The term "integrally knit," as used herein, may mean a knitted component having a yarn from one or more knitted courses in a first area being interlooped with one or more knitted courses of another area. The interlooping may be through a simple knit stitch, a tuck stitch, a held stitch, a float or miss stitch, and the like. In this way, areas that are integrally knit together have a seamless transition.

Additionally, there are various measurements provided herein. Unless indicated otherwise, the term "about" or "substantially" with respect to a measurement means within +10% of the indicated value.

Figure 2:
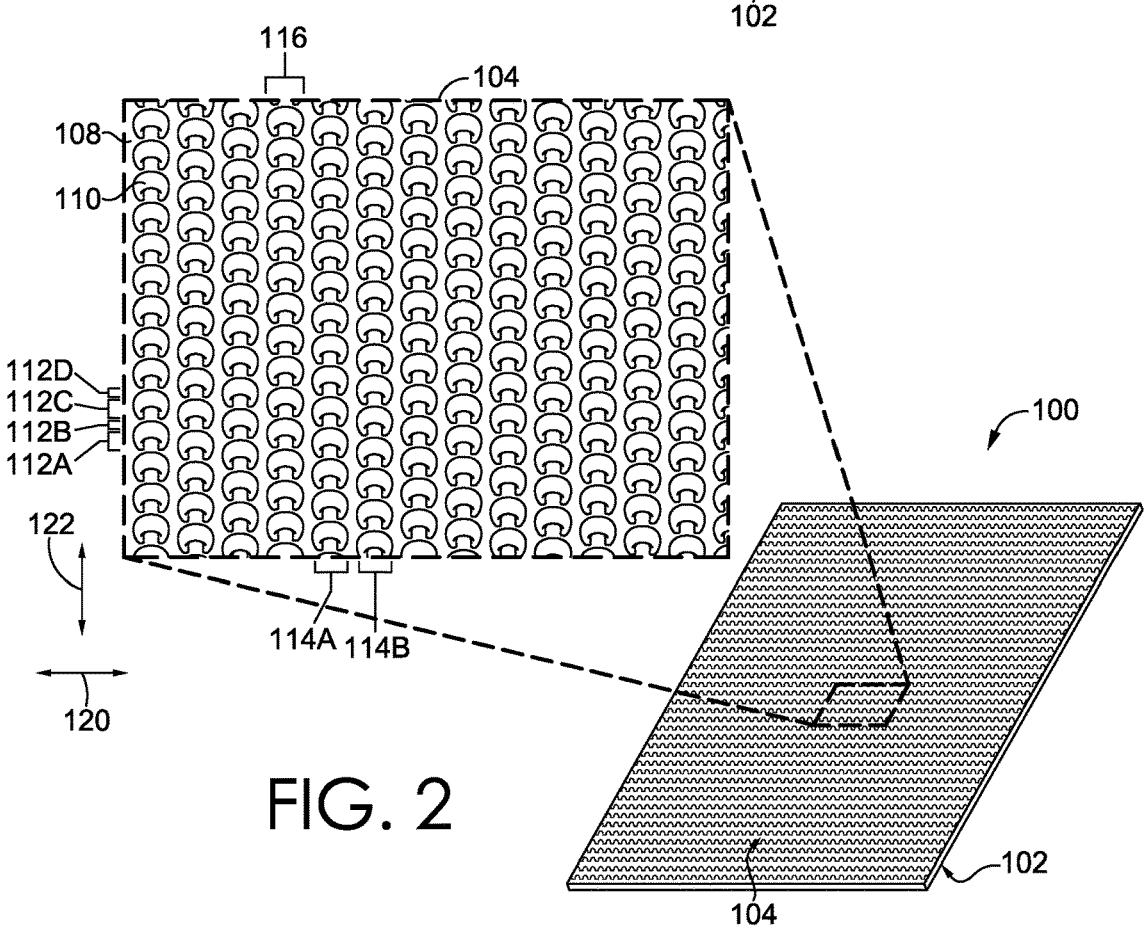
FIG. 2 depicts a second surface of the knitted component of FIG. 1 in accordance with aspects herein.

FIGS. 1 and 2 depict first and second sides, respectively, of an example knitted component 100 with inlay plush in accordance with aspects here. The knitted component 100 may be suitable for a number of applications, such as footwear, apparel, and industrial textiles. The knitted component 100 may be formed as an integral one-piece element from a single knitting process, such as a weft knitting process done one two or more needle beds as described further herein. Although the knitted component 100 depicted in FIGS. 1 and 2 appears to be fully knit, it is contemplated that the knitted component 100 depicted in FIGS. 1 and 2 may represent only a portion of a textile, where other materials, structures, textures may be incorporated into other portions of the textile using knitting or non-knitting processes.

The knitted component 100 includes a first surface 102 located on a first side of the knitted component 100 and a second surface 104 located opposite from the first surface 102 on a second side of the knitted component 100. Close-up views of the first surface 102 and the second surface 104 of the knitted component 100 are depicted in FIGS. 1 and 2, respectively. The first surface 102 and the second surface 104 are integrally knitted such that, for example, the first surface 102 may be the technical face of the knitted component 100 and the second surface 104 may be the technical back of the knitted component 100.

Various yarns are used to form the knitted component 100. For instance, a first yarn 106 may form at least part of the first surface 102, while a second yarn 108 and a third yarn 110 may form at least part of the second surface 104. On the first surface 102, the first yarn 106 may follow a first stitch sequence. The first stitch sequence may include one or more knit stitches and one or more missed stitches. An example first stitch sequence is further described with respect to FIGS. 3 and 4. On the second surface 104, the second yarn 108 may follow a second stitch sequence, which may include one or more tuck stitches. An example of the second stitch sequence is further described with respect to FIGS. 3 and 4. Further, the third yarn 110 may form loops (see a loop 116 in FIG. 2 for example) extending outward from the second surface 104. These loops are not formed by releasing the third yarn 110 from a needle and are not extending in a course-wise or wale-wise direction. Rather, the loops, e.g., such as the loop 116 of the third yarn 110 shown in FIG. 2, generally extend perpendicular to the course-wise direction and the wale-wise direction. The course-wise direction is generally indicated by arrow 120 in FIGS. 1-7, and the wale-wise direction is generally indicated by arrow 122 in FIGS. 1-7.

The loops of the third yarn 110 may be bound or locked into place by stitches (e.g., tuck stitches) of the second yarn 108. Additionally, because the first stitch sequence of the first yarn 106 includes a combination of knit stitches and missed stitches, the first surface 102 may experience a greater drawing in compared to a stitch sequence without missed stitches. As used herein, "drawing in" refers to the reduction in width of the courses of knitted component 100 that occurs after they are released from the tension of the needles and/or when the knitted component 100 is removed from the knitted machine. This drawing in of the first surface 102 creates a tension that biases the third yarn 110 to extend outward from the second surface 104, thereby creating loops, such as the loop 116.

Figure 3:
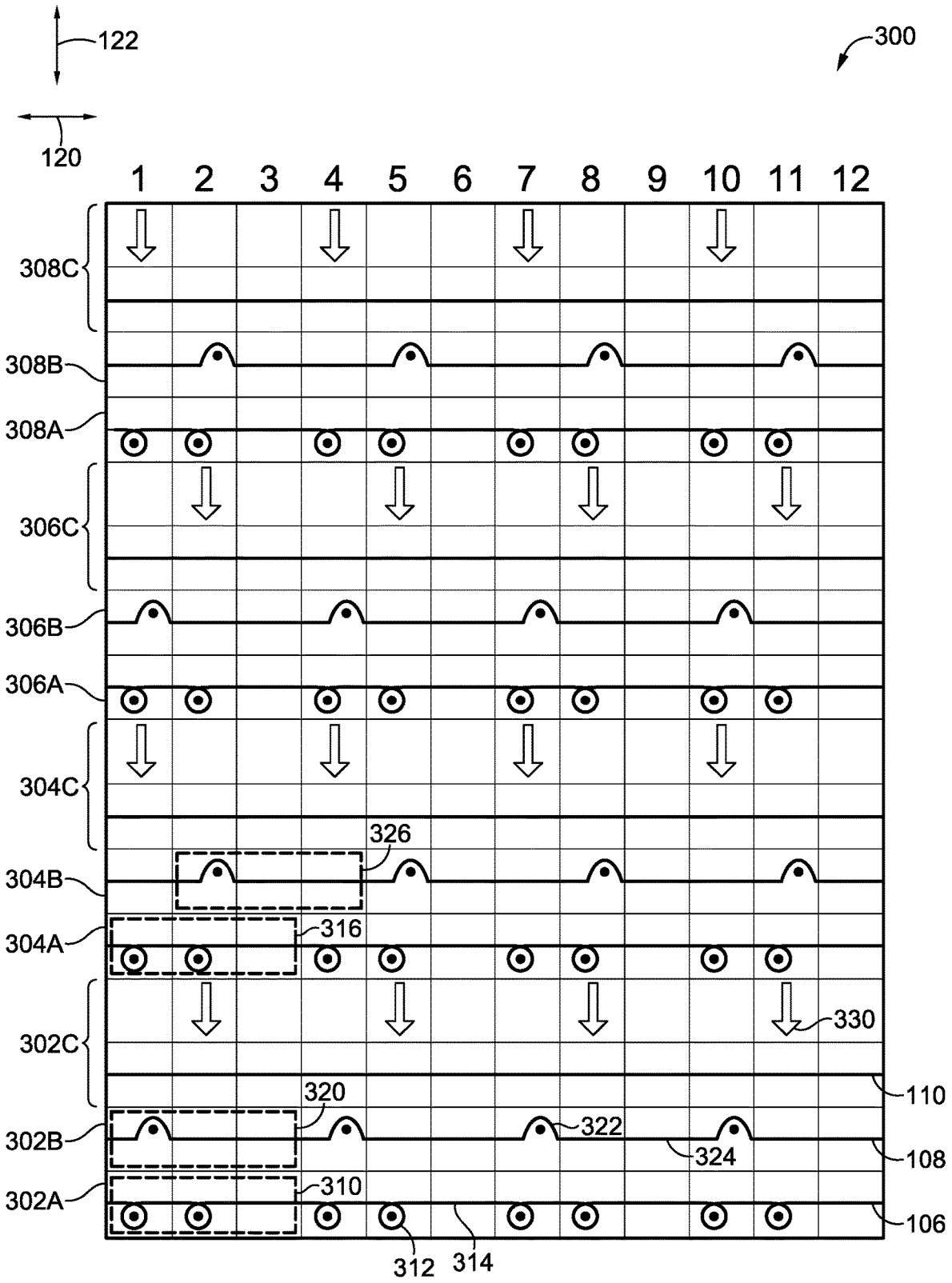
FIG. 3 depicts a knit diagram for forming a knitted component with a plush portion in accordance with aspects herein.
Figure 4:
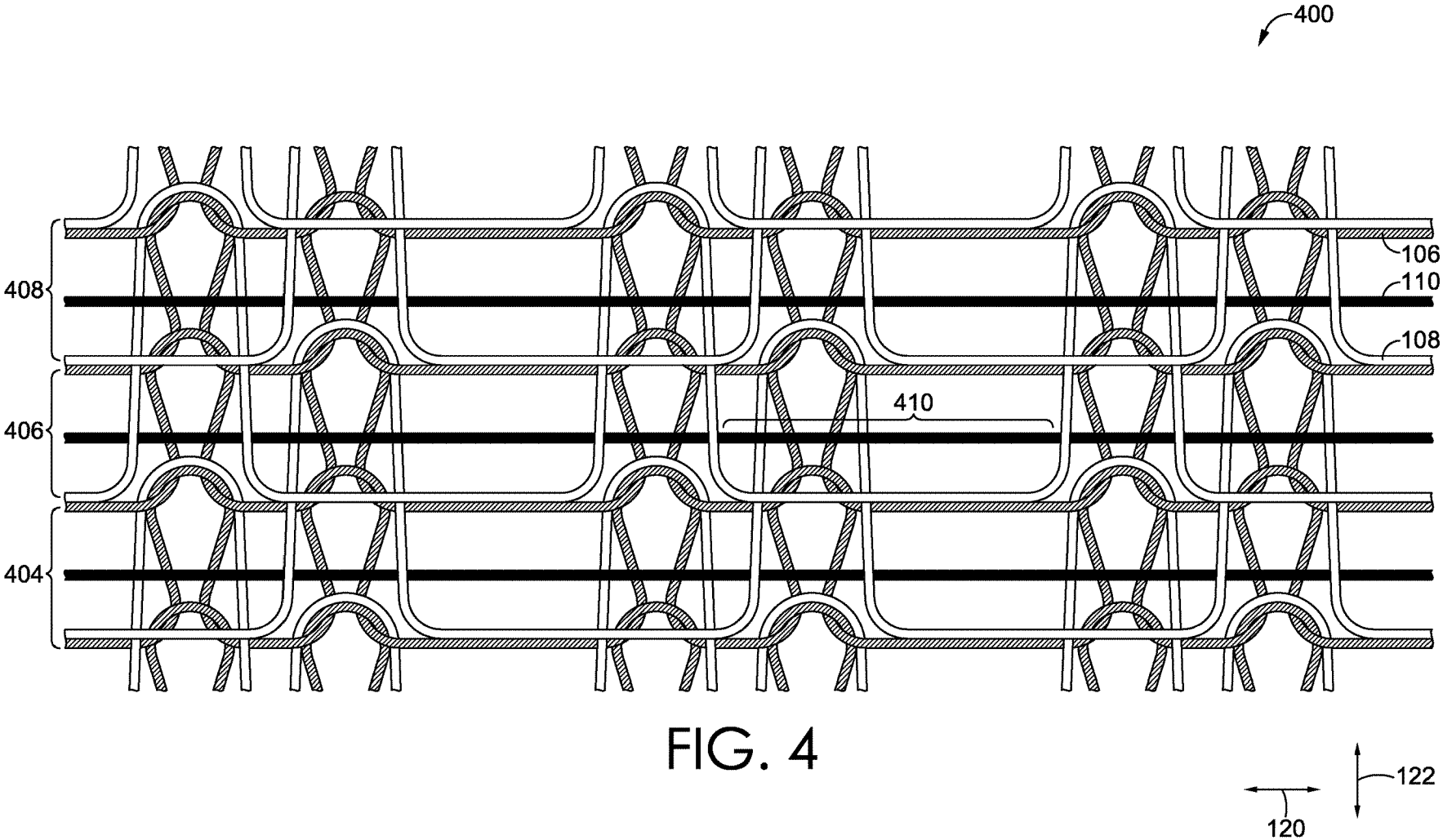
FIG. 4 depicts a schematic knit structure of a knitted component with a plush portion in accordance with aspect herein.

As described further with respect to FIGS. 3 and 4, the tuck stitches of the second yarn 108 may engage with knit stitches (i.e., knit loops) of the first yarn 106 by virtue of the tuck stitches being transferred from one bed to another during knitting. In example aspects, each tuck stitch of the second yarn 108 is looped with a knit stitch of the first yarn 106 so that a portion of the second yarn 108 runs parallel with the knit stitch of the first yarn 106. As such, the first surface 102 may also be partially formed by the second yarn 108 where the second yarn 108 tucks with a loop of the first yarn 106.

In example aspects of the knitted component 100, adjacent courses may generally follow the same stitch sequence for the second yarn 108, but the sequence may start at different wales so that the positions of tuck stitches of the second yarn 108 in adjacent courses may be offset from one another. As a result, the positions of loops of the third yarn 110 may be offset. For example, on the second surface 104, adjacent courses 112A, 112B, 112C, and 112D are depicted with the third yarn 110 extending as loops between tuck stitches of the second yarn 108. The loops of the third yarn 110 align across the same wales in alternating courses, while the loops of the third yarn 110 are offset in adjacent courses. For example, in courses 112A and 112C, the third yarn 110 forms loops in wale 114A but not in wale 114B, while in courses 112B and 112D, the third yarn 110 forms loops in wale 114B but not in wale 114A. While the stitch sequence of the second yarn 108 may change positions across adjacent courses, resulting in offset loops in the second surface 104 across adjacent courses, the stitch sequence of the first yarn 106 may be uniform in adjacent courses of the first surface 102. In other words, the missed stitches and the knit stitches of the first yarn 106 in adjacent courses may align within the same wales.

The first yarn 106, the second yarn 108, and the third yarn 110 may be formed of one or more various materials, which may lend to various properties. For example, cotton, elastane, polyester, rayon, wool are example materials that may be used for the first yarn 106, the second yarn 108, and/or the third yarn 110. Further, any of the first yarn 106, second yarn 108, and third yarn 110 may be single filament (also referred to as a monofilament yarn), or a plurality of filaments group together (also referred to as a multifilament yarn). Each yarn may include separate filaments formed of different materials or the yarn may include filaments that are each formed of the same material. In some aspects, none of the first yarn 106, the second yarn 108, or the third yarn 110 contain elastane. In other aspects, one or more of these yarns may contain elastane.

In one example, the first yarn 106 forming at least part of the first surface 102 may comprise a polyester yarn, or a yarn with one or more polyester filaments. The second yarn 108 may be the same type of material as the first yarn 106 or may be a different type of material. In some aspects, the first yarn 106 is fusible. For instance, the first yarn 106 may include polyester core with a thermoplastic polymer coating or may include filaments of polyester and filaments of a thermoplastic polymer. Including a fusible material on the first surface 102 via the first yarn 106 may be useful to at least partially fuse portions of the first yarn 106 to the second yarn 108 where the second yarn 108 is tucked around the knitted loops on the first yarn 106. Such fusion may help lock into place the plush loops (i.e., the loops of the third yarn 110 that are bound by tuck stitches of the second yarn 108) while allowing the second surface 104 to primarily remain unfused and have a soft hand. In some aspects, the second yarn 108 includes at least some common material with the first yarn 106, such as polyester, but does not include a fusible composition. In other aspects, the second yarn 108 also includes a fusible material, which may have the same melting temperature or a greater melting temperature than the fusible material of the first yarn 106.

In example aspects, the third yarn 110 is formed of a different type of material than the first yarn 106 and the second yarn 108. In some aspects, the third yarn 110 may have a higher denier than each of the first yarn 106 and the second yarn 108. Further, in some aspects, the third yarn 110 may have a lower denier than each of the first yarn 106 and the second yarn 108, which may result in a softer feel as well as greater moisture wicking or moisture absorbing properties of the third yarn 110 when compared to the first and second yarns 106 and 108, respectively. Further, in some aspects, the third yarn 110 may have a lower elasticity than the first yarn 106 and/or the second yarn 108, which may result in loops having a greater radius of curvature, dimensionality, and/or protrusion than other parts of the knitted component 100 formed by the remaining yarns 106 and 108, and may facilitate closer alignment of the loops along a wale-wise direction or column. In one aspect, the third yarn 110 may have substantially no elasticity. A known length of the yarn sample and its corresponding weight are measured. In some aspects, the third yarn 110 may include one or more cotton fibers. Further, the third yarn 110 may be a non-fusible yarn or may comprise a material with a higher temperature than at least the melting point of the material of the first yarn 106, where the temperature of the third yarn 110 may be the lowest of the melting temperature or decomposition temperature.

The denier of a yarn is the weight in grams of 9,000 meters of the yarn. To determine the denier of a particular yarn, a sample of the yarn is prepared. For example, to test a sample of a yarn, the yarn to be tested is stored at room temperature (20 degrees Celsius to 24 degrees Celsius) for 24 hours prior to testing. The first three meters of material are discarded. A sample yarn is cut to a length of approximately 30 millimeters with minimal tension at approximately room temperature (e.g., 20 degrees Celsius).

Turning to FIG. 3, an example knit diagram 300 for forming the knitted component 100 of FIGS. 1 and 2 is provided. This knit diagram 300 depicts techniques that may be utilized by a knitting machine. The knit diagram 300 may be used for a double-bedded knitting machine, such as a v-bed flat knitting machine. As such, some rows of the knit diagram 300 depict courses knit on a front needle bed, and some rows depict courses knit on a back needle bed. The combination of a front needle bed row (e.g., row 302A) and a back needle bed row (e.g., 302B) may effectively correspond to a course in the resulting knitted component. Further, each column (numbered 1 through 12) in the knit diagram 300 represents a needle position, corresponds in a wale in the resulting knitted component. Courses on front and back needle beds may be knit simultaneously using feeders to supply yarns to each bed. In this example, the first yarn 106 is shown as being knit on a front needle bed in rows 302A, 304A, 306A, and 308A, and the second yarn 108 is shown as being knit on a back needle bed in rows 302B, 304B, 306B, and 308B. Alternatively, the first yarn 106 may be knit in accordance with the same stitch sequence shown in FIG. 3 on the back needle while the second yarn 108 may be knit in accordance with same stitch sequence shown in FIG. 3 on the front needle bed.

Additionally, a third feeder, which may be a combination feeder, may be utilized to supply an inlaid yarn strand. For example, the knit diagram 300 shows the third yarn 110 being inlaid within rows 302C, 304C, 306C, and 308C. Although each inlaid yarn row (e.g., 302C) is depicted above the pairs of front and back courses (e.g., 302A and 302B), it will be appreciated that the third yarn 110 in row 302C is inlaid between the front and back needles shown in rows 302A and 302B, respectively.

Each row of the first yarn 106 depicts a first stitch sequence, shown in box 310, which is repeated multiple times across the row. The first stitch sequence includes a quantity of knit stitches, such as knit stitch 312, and a quantity of missed stitches, such as missed stitch 314. A knit stitch 312 may occur when the yarn 106 is picked up by a needle and released as a loop that is engaged with a loop from a previous row. The missed stitch 314 may occur when the first yarn 106 is not picked up by a needle such that the first yarn 106 extends in an un-looped form at a given needle position. In this example, the first stitch sequence includes two knit stitches 312 and one missed stitch 314. It is contemplated, however, that different quantities of the knit stitches 312 and/or missed stitch 314 may be utilized for the first stitch sequence shown in the box 310.

Each row of the second yarn 108 depicts a second stitch sequence, shown by box 320, which is repeated multiple times across a row. The second stitch sequence includes a quantity of tuck stitches, such as a tuck stitch 322. The tuck stitch 322 may be created when the second yarn 108 is picked up by a needle but is held by the needle rather than being released when a new row is formed. In this example, the quantity of tuck stitches in the second stitch sequence is one. The second stitch sequence may also include a quantity of missed stitches, such as a missed stitch 324. Similar to the missed stitches 314 of the first yarn 106, the missed stitches 324 of the second yarn 108 may be occur when the second yarn 108 is not being picked by up a needle. In one example, the second stitch sequence includes one tuck stitch 322 followed by two missed stitches 324 as shown in the box 320.

While a first feeder of the knitting machine is knitting the first yarn 106 in accordance with the first stitch sequence and a second feeder is knitting the second yarn 108 in accordance with the second stitch sequence, a third feeder may inlay the third yarn 110 between the two needles beds, which is shown in rows 302C, 304C, 306C, and 308C. The third yarn 110 does not form any loops around the needles such that the third yarn 110 does not engage with loops from other courses.

Additionally, while the third yarn 110 is being inlaid, tuck stitches 322 of the second yarn 108 from the previous row are transferred from the back needle bed to the front needle bed so that each tuck stitch 322 of the second yarn 108 is engaged with a knit stitch of the first yarn 106. The transfers are shown by arrows 330 in the knit diagram 300 of FIG. 3. As stated, the transfer that occurs when an inlaid row, such as 302C, is created, is performed for tuck stitches 322 that are held from a previously knit row. For instance, the transfers occurring when the third yarn 110 is inlaid in row 304C are transfers of the tuck stitches 322 in row 302B, which is depicted in the knit diagram 300 where the transfer arrows 330 in row 304C are in the same needle positions (positions 1, 4, 7, and 10) as the tuck stitches 322 of the second yarn 108 in row 302B. In other words, with each pass of the carriage of the knitting machine, tuck stitches 322 created from the previous pass of the carriage are moved from one needle bed to another.

The transfers of the tuck stitches 322 of the second yarn 108 from the back needle bed to the front needle bed help to lock in the third yarn 110 between the positions of the tuck stitches 322 so that the portions of the third yarn 110 between the tuck stitches 322 will form loops extending out from the surface of the knitted component. Additionally, as shown in the example of FIG. 3, because the tuck stitches are transferred to the front needle bed and no other knitted loops are created on the back needle bed in this example, the resulting knitted component (e.g., the knitted component 100) may be effectively a single knit layer even though two needle beds are used in knitting the knitted component.

Additionally, the knit diagram 300 depicts the second stitch sequence starting in different needle positions in adjacent rows. For example, the box 320 shows the second stitch sequence shown extending from needle positions 1 through 3 in row 302B, and a box 326 showing the second stitch sequence in the next row 304B extends from needle positions 2 through 4. As such, rows may alternate between the first tuck stitch 322 of the second yarn 108 being at needle position 1 and the first tuck stitch 322 being at needle position 2. Because the needle positions of the tuck stitches 322 alternate, the positions of the transfers of the tuck stitches 322 shown by arrows 330 also alternate. Alternating positions of the tuck stitches 322 of the second yarn 108 results in the loops of the third yarn 110 extending from the second surface 104 being offset from one another in adjacent knit courses. Because the loops create additional surface area, having the loops offset may result in the loops being more evenly spaced out across the second surface 104 of the knitted component 100, rather than being bunched up.

Further, the first knit sequence may start in the same position in adjacent rows. For example, the box 320 shows the first stitch sequence extending from needle positions 1 through 3 in row 302A, and a box 316 shows the first stitch sequence extending from needle positions 1 through 3 in row 304A.

FIG. 4 depicts a schematic knit structure 400 of a sample of the knitted component 100 of FIGS. 1 and 2. The knit structure 400 includes knit courses 404, 406, and 408 formed with the first yarn 106, the second yarn 108, and the third yarn 110, which is inlaid. The knit courses 404, 406, and 408 may be knit according to the knit diagram 300 of FIG. 3 at needle positions 1 through 8 of rows 304A-C, 306A-C, and 308A-C, respectively. For example, the course 404 may be knit by forming the first stitch sequence with the first yarn 106 by knitting two knit stitches and one missed stitch repeatedly and by forming the second stitch sequence with the second yarn 108 by knitting one tuck stitch and two missed stitches repeatedly. As previously explained with respect to FIG. 3, the loops of the second yarn 108 forming the tuck stitches are held until they are transferred to another needle bed so that they are tucked with knit stitches in the next course.

The schematic knit structure 400 in FIG. 4 shows the yarns in extended positions with tension. However, it could be understood that, without tension, such as when the knitted portion extends off of the needles on the needle beds, portions of the third yarn 110 extending between transferred tuck stitches, such as portion 410, will form loops. These portions may extend outward, as depicted in the illustration of the second surface 104 in FIG. 2.

Figure 5:
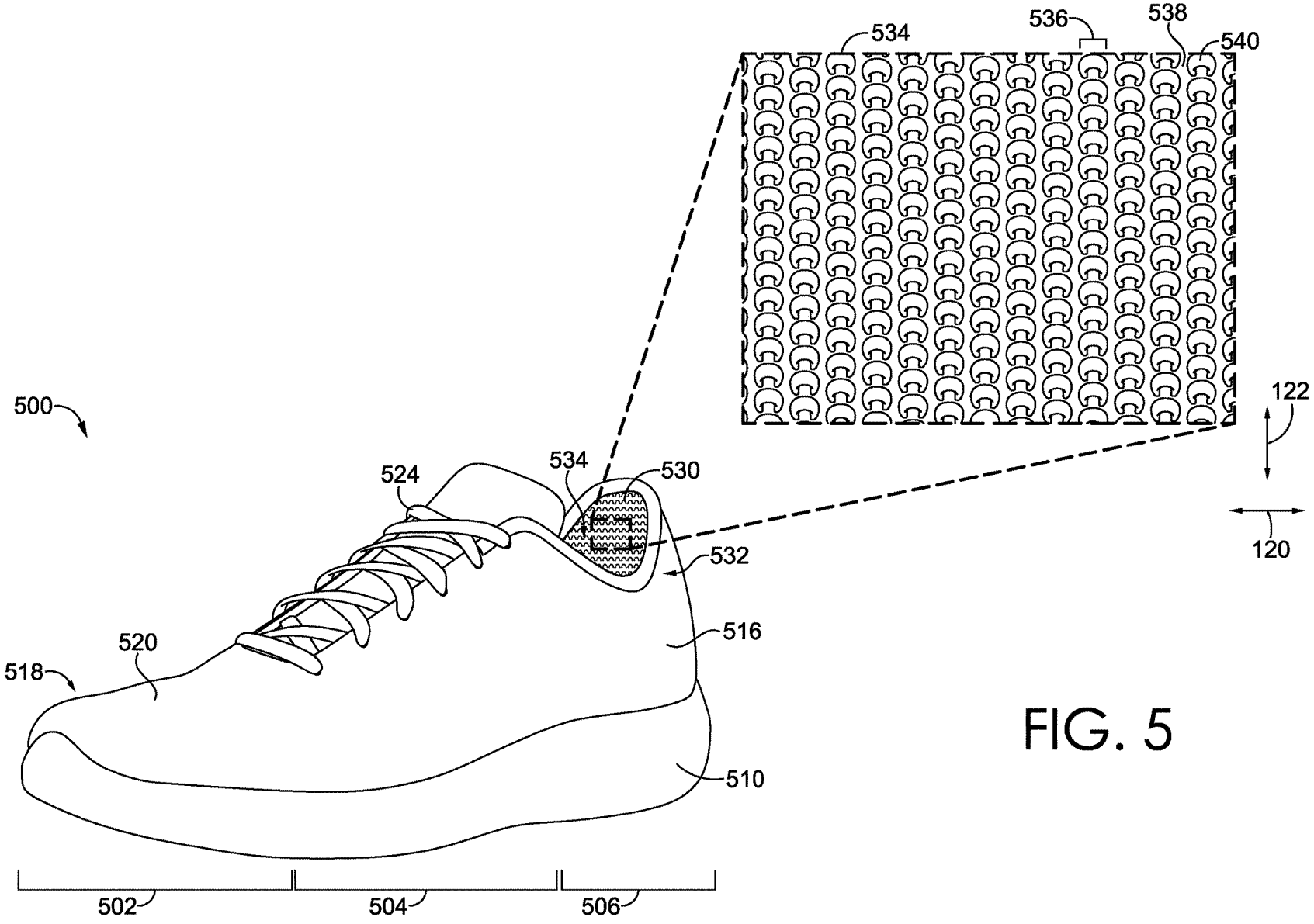
FIG. 5 depicts an article of footwear having a knitted component with a plush portion forming an interior surface in accordance with aspects herein.

The methods and features discussed with respect to the knitted component 100 may be incorporated into any suitable article. For example, FIG. 5 depicts an article of footwear 500 with an upper 520 formed of a knitted component 530 with inlay plush. The footwear 500 includes the upper 520 secured to a sole structure 510. The area of the footwear 500 where the sole structure 510 joins the upper 520 may be referred to as the biteline. The upper 520 may be joined to the sole structure 510 in a fixed manner using any suitable technique, such as through the use of an adhesive, by sewing, etc. It is contemplated that the upper 520 may extend partially or completely around the foot of a wearer, may extend under the foot of a wearer, and/or may be integral with the sole, and/or with a sockliner, which may be referred to as a strobel, which may or may not be used.

The footwear 500 may be divided into three general regions: a forefoot region 502, a midfoot region 504, and a heel region 506. The forefoot region 502 generally includes portions of the footwear 500 corresponding to the toes and joints connecting the metatarsals with the phalanges when the footwear 500 is worn. The midfoot region 504 generally includes portions of the footwear 500 corresponding with an arch of the foot when the footwear 500 is worn. The heel region 506 generally corresponds with rear portions of the foot, including the heel and calcaneus bone when the footwear 500 is worn. The footwear 500 also includes a lateral side 516 and a medial side 518, which each extend through regions 502, 504, and 506, and correspond to opposite sides of the footwear 500. More particularly, the lateral side 516 corresponds with an outside area of the foot (i.e., the side that faces away from the other foot) when the footwear 500 is worn, while the medial side 518 corresponds with an inside area of the foot (i.e., the side that faces towards the other foot) when the footwear 500 is worn. These regions 502, 504, and 506 and sides 516 and 518 are not intended to demarcate precise areas of the footwear 500 but, rather, are intended to represent general areas of the footwear 500 to aid in understanding the various descriptions provided herein.

Sole structure 510 generally extends between the foot and the ground when the footwear 500 is worn. The sole structure 510 may include multiple components, such as an outsole, a midsole, and an insole or sockliner. Various materials may be used to form the sole structure 510, such as rubber, ethylene vinyl acetate (EVA), thermoplastic polyurethane (TPU), thermoplastic elastomer (e.g., polyether block amide), and the like. The sole structure 510 may also include various other elements, such as a heel counter and a toe cap. The sole structure 510 may include various other features to attenuate forces, enhance stability, and/or provide traction, such as treads as understood by one skilled in the art.

The upper 520 defines a void within the footwear 500 for receiving and securing a foot relative to the sole structure 510. Access to the void is provided by an ankle opening located in at least the heel region 506.

At least a portion of the upper 520 may be formed of at least one knitted component 530. The knitted component 530 may be formed as a single integral one-piece element during a knitting process, such as weft knitting, warp knitting, or any other suitable knitting process. Additional elements, such as an underfoot portion and/or a heel element (including, but not limited to a heel counter or other elements or components) may be integrally formed with the upper 520 as a one-piece unitary structure. Alternatively, one or more such additional elements may be formed separately from the upper 520 and then later attached, secured, or otherwise assembled as necessary. Forming the upper 520 with the knitted component 530 may provide the upper 520 with advantageous characteristics including, but not limited to, a particular degree of elasticity, breathability, bendability, strength, moisture absorption, weight, abrasion resistance, and/or a combination thereof. Further, forming the upper 520 from an integrally knit knitted component 530 may form various features and structures of the upper 520 without the need for significant additional manufacturing steps or processes, thereby increasing production efficiency. Additionally, the upper 520 may include lace elements 524 that extends through lace apertures in the knitted component 530.

The knitted component 530 forming at least part of the upper 520 in FIG. 5 may have the same knit structure as the knitted component 100 of FIGS. 1-2. For instance, the knitted component 530 may include a plurality of loops formed by an inlaid yarn extending from one side. Similar to the knitted component 100, a first surface 532 of the knitted component 530 may be formed by a first yarn having a first stitch sequence. For simplicity, the texture of the first surface 532 and the details are not shown in FIG. 5, but it should be understood that it may have the same features as the first surface 102 in FIG. 1. As such, the first surface 532 may be formed by the stitch sequences shown in the knit diagram 300 of FIG. 3.

The knitted component 530 also includes a second surface 534 that may be formed from at least partially by a second yarn having a second stitch sequence that include tuck stitches. The second surface 534 may also include loops formed by a third yarn that extend between tuck stitches of the second yarn. In FIG. 5, the second surface 534 of the knitted component 530 is depicted in a close-up view to show the loops 536 formed by a third yarn 540. The loops 536 of the third yarn 540 are locked into place by transfers of the tuck stitches of the second yarn 538 from one needle bed to another during knitting. The second surface 534 of the knitted component 530 may have the same features as the second surface 104 of FIG. 2 and may be formed by the stitch sequences shown in the knit diagram 300 of FIG. 3.

The second surface 534 of the knitted component 530 forms an interior surface of the upper 520. In this way, the loops 536 extending from the second surface 534 may extend into the foot-receiving void and may be in contact with a wearer's foot when the footwear 500 is being worn. Forming the interior surface of the upper 520 with the second surface 534 of the knitted component 530 may provide comfort and moisture absorbing functionality. In some aspects, all or substantially all of the interior surface of the upper 520 is formed by the loops 536 of the knitted component 530. In other aspects, only part of the interior surface includes the loops 536. For example, portions of the interior surface in the heel region 506, along the overfoot portion, and/or at the ankle opening may be formed by the loops 536.

The opposite surface (the first surface 532) of the knitted component 530 may form the exterior surface of the upper 520 as shown in FIG. 5. In alternative aspects, one or more portions of the exterior surface of the upper 520 is formed by another component, such as another knitted component, another textile, or non-textile component. As such, a part of or all of the first surface 532 of the knitted component 530 may abut another component instead of forming the exterior of the upper 520. Where another knitted component forms at least part of the exterior surface of the upper 520, the knitted component may have a similar knit configuration as the knitted component 530 in that it may include inlay plush loops as described herein. In this way, the inlay plush loops formed in accordance with aspects of this disclosure may form part of the exterior surface as well as part of the interior surface of the upper 520. In some aspects, the knitted component including the inlay plush loops may form at least part of a strobel, among other things.

Figure 6:
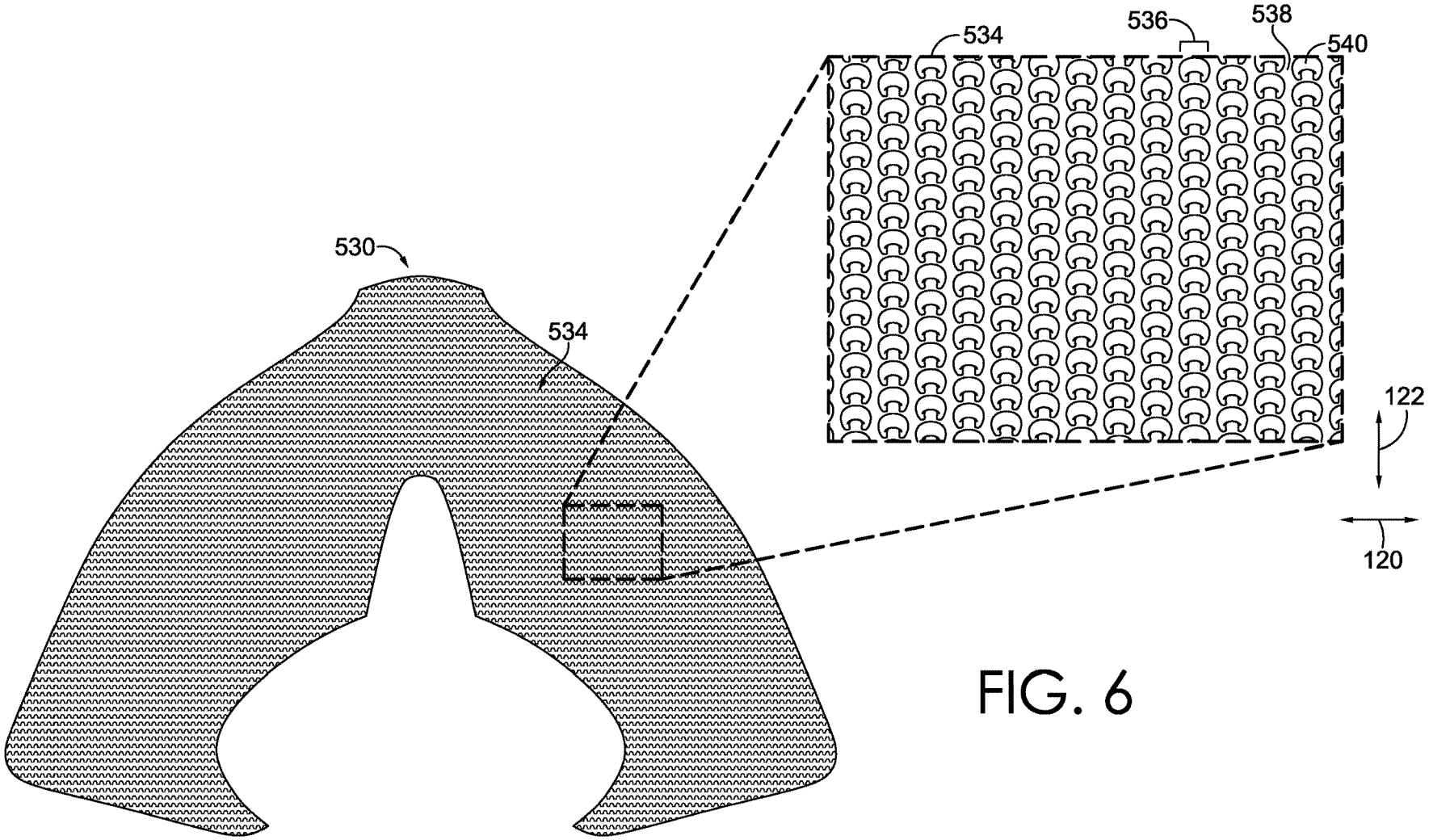
FIG. 6 depicts a knitted component with a plush portion forming an upper for an article of footwear in accordance with aspects herein.

FIG. 6 depicts the knitted component 530 where the knitted component 530 is in a relatively flat configuration. The configuration of the knitted component 530 in FIG. 6 may be just after knitting (and/or post-knitting processing) but before being folded or otherwise manipulated into a wearable shape of an upper, such as the upper 520 of FIG. 5. In this aspect, the knitted component 530 may take the shape of an upper such that the entire or substantially the entire upper 520 may be formed of the knitted component 530. The knitted component 530 forming the entire or substantially the entire upper 520 may be formed as a single integral one-piece element during a knitting process. As illustrated, the second surface 534 of the knitted component 530 includes a plurality of loops 536 of the third yarn 540 extending outward from the second surface 534. The second surface 534 with the loops 536 may form the entity or substantially the entirety of one surface, such as an interior surface, of the upper 520.

Figure 7:
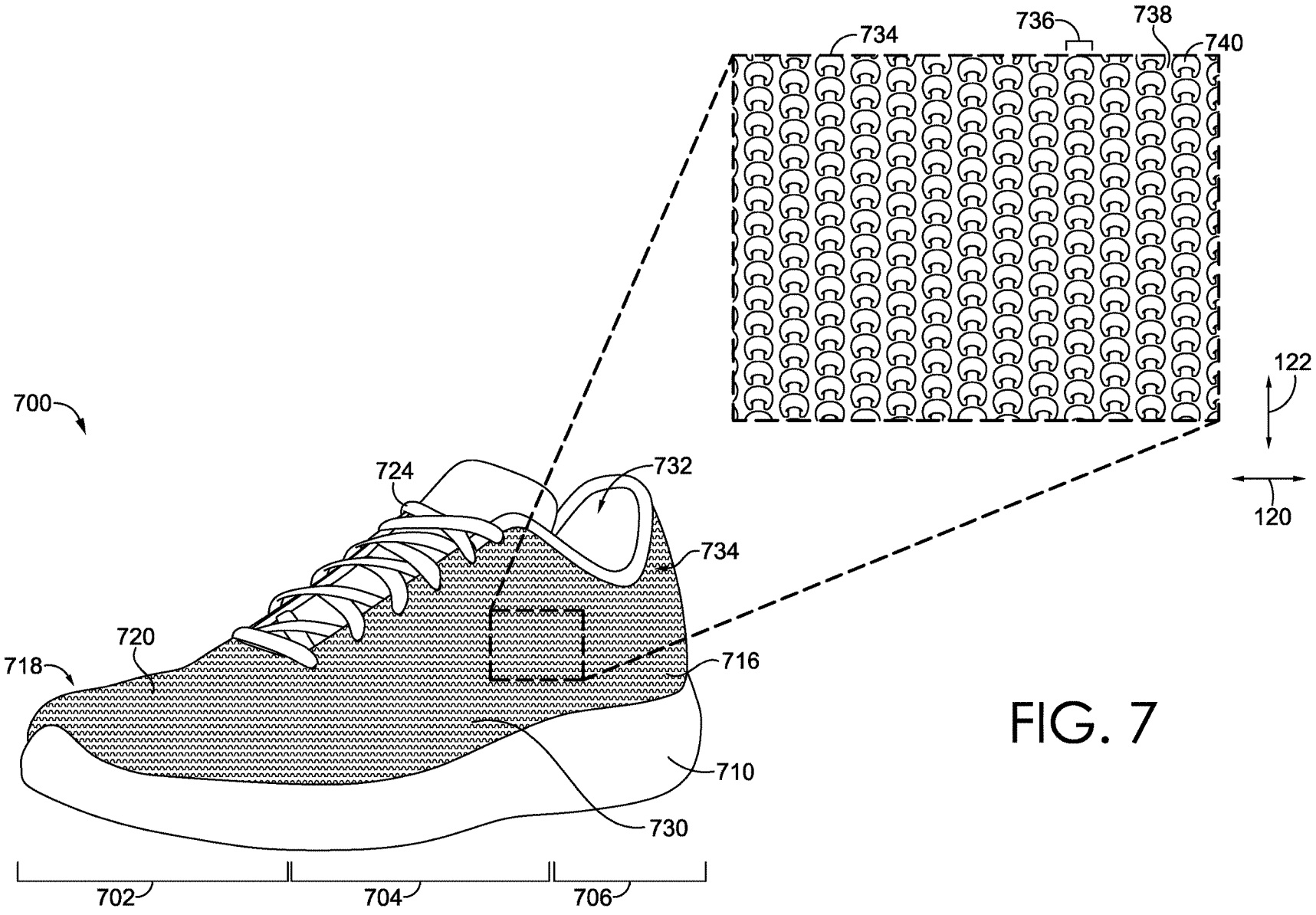
FIG. 7 depicts an article of footwear having a knitted component with a plush portion forming an exterior surface in accordance with aspects herein.

FIG. 7 depicts an article of footwear 700 with an upper 720 formed of a knitted component 730 with inlay plush. The footwear 700 includes the upper 720 secured to a sole structure 710, which may have the same configuration described for the sole structure 510 of FIG. 5. The upper 720 may be joined to the sole structure 710 in a fixed manner using any suitable technique, such as through the use of an adhesive, by sewing, etc. It is contemplated that the upper 720 may extend partially or completely around the foot of a wearer, may extend under the foot of a wearer, and/or may be integral with the sole, and/or with a sockliner or strobel, which may or may not be used.

The footwear 700 may be divided into three general regions: a forefoot region 702, a midfoot region 704, and a heel region 706 generally covering the areas as described with respect to regions 502, 504, and 506 of FIG. 5. The footwear 700 also includes a lateral side 716 and a medial side 718, which each extend through regions 702, 704, and 706, and correspond to opposite sides of the footwear 700 in a similar manner described with respect to sides 516 and 518 of FIG. 5.

At least a portion of the upper 720 may be formed of at least one knitted component 730, which may be formed as a single integral one-piece element during a knitting process, such as weft knitting, warp knitting, or any other suitable knitting process. Additional elements, such as an underfoot portion and/or a heel element (including, but not limited to a heel counter or other elements or components) may be integrally formed with the upper 720 as a one-piece unitary structure. Alternatively, one or more such additional elements may be formed separately from the upper 720 and then later attached, secured, or otherwise assembled as necessary. Forming the upper 720 with the knitted component 730 may provide the upper 720 with advantageous characteristics including, but not limited to, a particular degree of elasticity, breathability, bendability, strength, moisture absorption, weight, abrasion resistance, and/or a combination thereof. Further, forming the upper 720 from an integrally knit knitted component 730 may form various features and structures of the upper 720 without the need for significant additional manufacturing steps or processes, thereby increasing production efficiency. Additionally, the upper 720 may include lace elements 724 that extends through lace apertures in the knitted component 730.

The knitted component 730 forming at least part of the upper 720 in FIG. 7 may generally have the same knit structure as the knitted component 100 of FIGS. 1-2 as well as the knitted component 530 of FIG. 5. For instance, a first surface 732 of the knitted component 730 may be formed by a first yarn having a first stitch sequence. For simplicity, the texture of the first surface 732 and the details are not shown in FIG. 7, but it should be understood that it may have the same features as the first surface 102 in FIG. 1. As such, the first surface 732 may be formed by the stitch sequences shown in the knit diagram 300 of FIG. 3.

The knitted component 730 may also include a second surface 734 that may be formed from a second yarn 738 having a second stitch sequence that include tuck stitches and an loops formed by a third yarn 740 that extend between tuck stitches of the second yarn. In FIG. 7, the second surface 734 of the knitted component 730 is depicted in a close-up view to show the loops 736 formed by the third yarn 740. The loops 736 of the third yarn 740 are locked into place by transfers of the tuck stitches of the second yarn 738 from one needle bed to another during knitting. The second surface 734 of the knitted component 730 may have the same features as the second surface 104 of FIG. 2 and may be formed by the stitch sequences shown in the knit diagram 300 of FIG. 3.

The second surface 734 of the knitted component 730 forms an exterior surface of the upper 720 in FIG. 7. In this way, the loops 736 extending from the second surface 734 may extend out and contact the ambient environment when the footwear 700 is being worn. Forming the exterior surface of the upper 720 with the second surface 734 of the knitted component 730 may provide moisture management properties on the exterior surface as well as create a visual texture. In some aspects, all or substantially all of the exterior surface of the upper 720 is formed by the loops 736 of the knitted component 730. In other aspects, only a portion of the exterior surface includes the loops 736.

The opposite surface (the first surface 732) of the knitted component 730 may form the interior surface of the upper 720 as shown in FIG. 7. In alternative aspects, one or more portions of the interior surface of the upper 720 are formed by another component, such as another knitted component, another textile, or non-textile component. As such, a part of or all of the first surface 732 of the knitted component 730 may abut another component instead of forming the interior of the upper 720. Where another knitted component forms at least part of the interior surface of the upper 720, the other knitted component may have a similar knit configuration as the knitted component 730 in that it may include inlay plush loops as described herein. In this way, the inlay plush loops formed in accordance with aspects of this disclosure may form part of the interior surface as well as part of the exterior surface of the upper 720 in FIG. 7.

Figure 8:
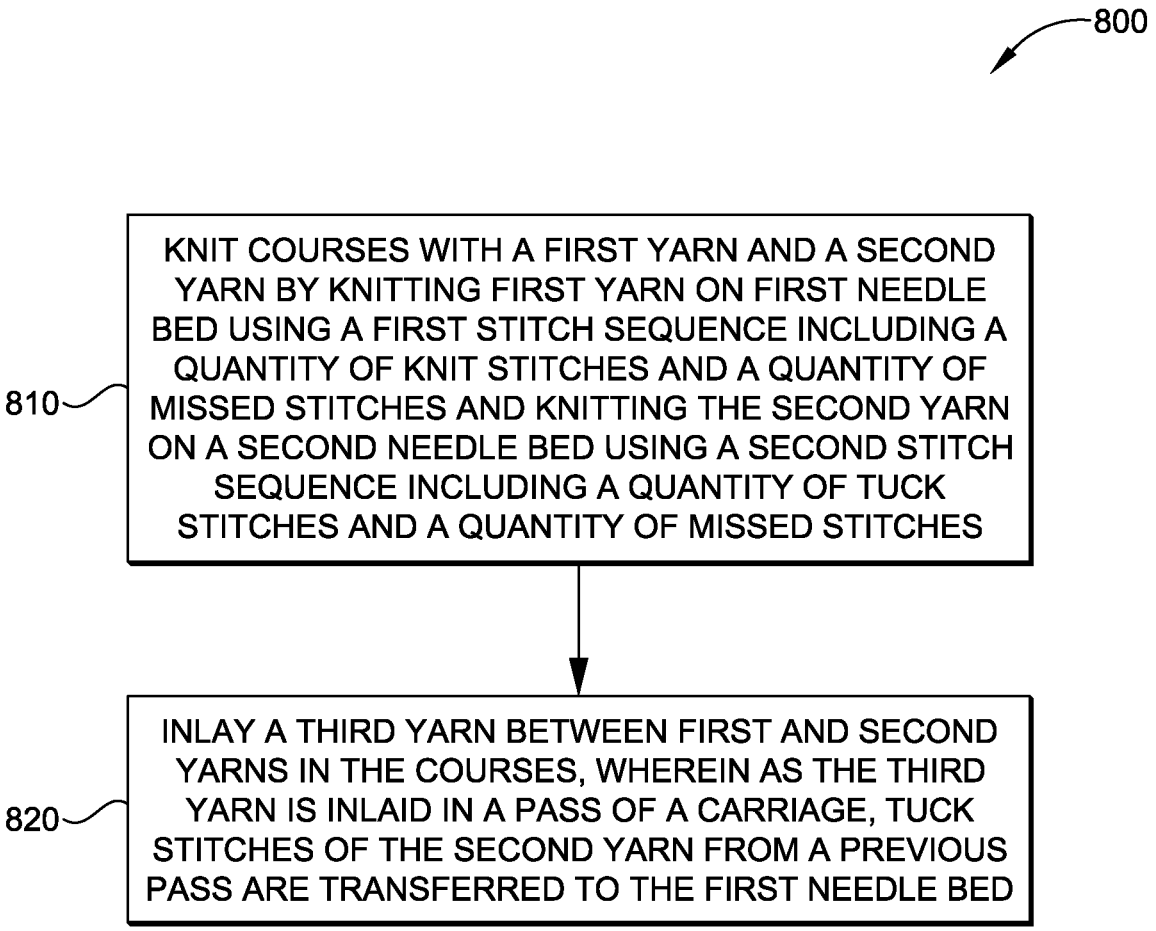
FIG. 8 depicts a flow diagram of an example method of making a knitted component with a plush portion, in accordance with aspects herein.

FIG. 8 illustrates a flow diagram depicting an example method 800 of manufacturing a knitted component, such as the knitted component 100, the knitted component 530, or the knitted component 730 of FIG. 1-4, 5, or 7 respectively. The steps provided in method 800 are merely illustrative, and method 800 may include additional steps that are not illustrated. At least some of the steps of method 800 are indicated as being performed on a knitting machine, which may be an automated knitting machine. As such, one or more of these steps may be performed and/or controlled using a control unit having a processor or computer communicatively coupled with or integrated into the knitting machine. In example aspects, the knitting machine used to carry out steps of method 800 is a V-bed flat knitting machine having two needle beds—a front needle bed and a back needle bed—that are angled relative to each other to form a V-shaped bed. The front and back needle beds may each include a plurality of individual needles extending across a common plane. A carriage may move feeders, such as standard and/or combination feeders, along the front and back needle beds to supply yarns to needles. Generally, standard feeders and combination feeders both supply yarn for needles to knit, tuck, and/or float, while combination feeders may also supply yarn to inlay through or between knitted structures. Although a flat V-bed knitting machine is described herein, it should be understood that this is one example and that other knitting machines may be used be used to form the knitted component or a portion thereof. Similarly, in example aspects, the knitting steps within method 800 may be weft knitting processes.

At step 810 of the method 800, courses are knit with a first yarn, which may be similar to the first yarn 106 of FIGS. 1, 3, and 4, and a second yarn, which may be similar to the second yarn 108 of FIGS. 2-4. Step 810 may be performed by knitting the first yarn on a first needle bed of a knitting machine using a first stitch sequence, and knitting the second yarn on a second needle bed of the knitting machine using a second stitch sequence. The first needle bed may be a front needle bed, while the second needle bed may be the back needle bed; but in alternative aspects, the first needle bed may be the back needle bed where the second needle bed may be the front needle bed. As such, the first yarn may form at least part of a first surface of the knitted component while the second yarn may form at least part of a second surface, opposite the first surface. Additionally, the first yarn may be supplied for a first feeder, and the second yarn may be supplied a second feeder. The first and second feeders may be standards feeders or combination feeders.

The first knit sequence may include a quantity of knit stitches and a quantity of missed stitches. In one aspect, the first stitch sequence consists of two knit stitches adjacent one missed stitch. The second stitch sequence may include quantity of tuck stitches and a quantity of missed stitches. In one aspects, the second stitch sequence consists of one tuck stitch adjacent two missed stitches. The first and second knit sequences may be repeated at least once across each course.

At step 820, a third yarn, which may be similar to the third yarn 110 of FIGS. 2-4, is inlaid between first and second yarns in the courses. The third yarn may be supplied by a third feeder, which may be a combination feeder. The first yarn, second yarn, and third yarn may be fed to the respective needle beds or inlaid therebetween within a pass of a carriage of the knitting machine. In the pass of a carriage in which the third yarn is inlaid, tuck stitches of the second yarn held on needles from the previous pass of the carriage may be transferred from the second needle bed to the first needle bed. Transferring the tuck stitches from the second needle bed to the first needle bed effectively creates a single knit structure, and locks into place the inlaid third yarn. An example of the first and second stitch sequences as well as the transfers is depicted in FIG. 3.

These sequences may be repeated for a plurality of courses. As new courses are being knit in accordance with steps 810 and 820, previously knit courses are moved away from the needles on the needle bed. Without the tension applied by the needle bed, the knitted component may experience a drawing in. Additional drawing in may be promoted by the presence of missed stitches in the first and second sequences. Although the knitted component experiences the drawing in, the inlaid third yarn may be locked into place in select areas at least partly due to the transfers of the tuck stitches of the second yarn. As such, loops of the third yarn are formed between the tuck stitches. The combination of knit stitches and missed stitches with the first yarn on the first surface forces the loops to extend outward in the other direction so that the loops extend outward from the second surface. The loops created by the inlaid third yarn may provide a plush texture that is conventionally achieved in knitting only through use of additional specialized equipment. Using the inlaid yarn to create loops that are locked into place by transfers of tuck stitches from one needle bed to another enables creation of the plush texture without additional specialized equipment for the knitting machine.

In some aspects of the method 800, the needle on which the second stitch sequence starts alternates between a plurality of needles. In one example, the start of the second stitch sequence alternates between two needles. For instance, in a first course, the second stitch sequence may start with a tuck stitch on the first needle; in a second course knit after the first course, the second stitch sequence may start with a tuck stitch on the second needle that is adjacent the first needle; and in a third course knit after the second course, the second stitch sequence may start with a tuck stitch on the first needle again. Alternating positions of the start of the second stitch sequence results in loops of the third yarn being offset from each other in adjacent courses, which may create a more spread out and uniform arrangement of the loops across the second surface of the knitted component. In example aspects, the first stitch sequence is uniform or aligned across adjacent courses such that the first stitch sequence may start at the same needle position in adjacent courses.

Further some aspects of the method 800 may include one or more post-knitting processes. For instance, in one example, at least the first yarn is a fusible yarn, and the method 800 includes applying heat to at least part of the first surface to at least partially fuse the first yarn to the second yarn. This fusion may help further lock the loops of the inlaid third yarn into place between the tuck stitches of the second yarn. Additionally, the method 800 may also include removing the knitted component from the knitting machine, forming the knitted component into an upper for an article of footwear, and securing the knitted component to one or more sole structures, such as a sockliner, a midsole, or an outsole.

When the knitted component is formed into an upper, the knitted component may be arranged so that the second surface with the loops of the third yarn may form at least part of interior surface of the upper, similar to the upper 520 of FIG. 5. In other aspects, the knitted component may be formed into an upper so that the loops extending from the second surface may form at least part of the exterior of the upper, similar to the upper 720 of FIG. 7.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are illustrative in nature and are not limiting.

Clause 1: A knitted component for an article, the knitted component comprising: a first surface and a second surface facing opposite the first surface; a plurality of courses comprising a first yarn and a second yarn; and a plurality of loops extending outward from the second surface, each loop being formed of a third yarn that is inlaid within the plurality of courses, wherein the first yarn has a first stitch sequence within each course of the plurality of courses, the first stitch sequence comprising a quantity of knit stitches and a quantity of missed stitches forming at least part of the first surface, wherein the second yarn has a second stitch sequence within each course of the plurality of courses, the second stitch sequence comprising a quantity of tuck stitches forming at least part of the second surface, each tuck stitch of the second yarn being looped with a knit stitch of the first yarn, wherein each of the first stitch sequence and the second stitch sequence is repeated at least once in each course of the plurality of courses.

Clause 2: The knitted component according to clause 1, wherein the first stitch sequence consists of two knit stitches adjacent one missed stitch.

Clause 3: The knitted component according to any of clauses 1 to 2, wherein the second stitch sequence consists of one tuck stitch adjacent two missed stitches.

Clause 4: The knitted component according to any of clauses 1 to 3, wherein, within each course of the plurality of courses, two adjacent missed stitches of the second yarn align within the same two wales as one knit stitch and one missed stitch of the first yarn.

Clause 5: The knitted component according to any of clauses 1 to 4, wherein the second stitch sequence of the second yarn is offset in adjacent courses.

Clause 6: The knitted component according to any of clauses 1 to 5, wherein the second stitch sequence of the second yarn is offset by one wale in adjacent courses.

Clause 7: The knitted component according to any of clauses 1 to 6, wherein the first stitch sequence of the first yarn is aligned across adjacent courses.

Clause 8: The knitted component according to any of clauses 1 to 7, wherein each loop of the third yarn is positioned between two tuck stitches of the second yarn.

Clause 9: An article of footwear comprising an upper having the knitted component according to any of clauses 1 to 8.

Clause 10: A method of manufacturing the knitted component according to any of clauses 1 to 8.

Clause 11: An article of footwear comprising: an upper having a knitted component, the knitted component comprising: a first surface and a second surface facing opposite the first surface; a plurality of courses comprising a first yarn and a second yarn; and a plurality of loops extending outward from the second surface, each loop being formed of a third yarn that is inlaid within the plurality of courses, wherein the first yarn has a first stitch sequence within each course of the plurality of courses, the first stitch sequence comprising a quantity of knit stitches and a quantity of missed stitches forming at least part of the first surface, wherein the second yarn has a second stitch sequence within each course of the plurality of courses, the second stitch sequence comprising a quantity of tuck stitches forming at least part of the second surface, each tuck stitch being looped with a knit stitch of the first yarn, wherein each of the first stitch sequence and the second stitch sequence is repeated at least once in each course of the plurality of courses.

Clause 12: The article of footwear according to clause 11, wherein the first stitch sequence consists of two knit stitches adjacent one missed stitch, and the second stitch sequence consists of one tuck stitch adjacent two missed stitches.

Clause 13: The article of footwear according to any of clauses 11 to 12, wherein the plurality of courses comprises a plurality of adjacent courses.

Clause 14: The article of footwear according to any of clauses 11 to 13, wherein the second surface forms at least part of an interior surface of the upper.

Clause 15: The article of footwear according to any of clauses 11 to 14, wherein the first yarn comprises a fusible yarn that is at least partially fused with the second yarn.

Clause 16: The article of footwear according to any of clauses 11 to 15, wherein the first yarn has a first melting temperature and the third yarn has a third temperature that is greater than the first melting temperature, wherein the third temperature is the lower of a melting temperature or a decomposition temperature of the third yarn.

Clause 17: The article of footwear according to any of clauses 11 to 16, wherein the plurality of loops formed by the third yarn are positioned in a first area of the knitted component, wherein a second area of the knitted component is integrally knitted with the first area and does not include loops extending outward from the second surface.

Clause 18: A method of manufacturing the article of footwear according to any of clauses 11 to 17.

Clause 19: A method of manufacturing a knitted component, the method comprising: knitting a plurality of courses with a first yarn and a second yarn; and inlaying a third yarn between the first yarn and the second yarn within each course within the plurality of courses, wherein each course within the plurality of courses is knit by: knitting the first yarn on a first needle bed of a knitting machine using a first stitch sequence, the first stitch sequence being repeated at least once and including a quantity of knit stitches and a quantity of missed stitches, and knitting the second yarn on a second needle bed of the knitting machine using a second stitch sequence, the second stitch sequence being repeated at least once and including a quantity of tuck stitches and a quantity of missed stitches, wherein, as the third yarn is inlaid in a pass of a carriage on the knitting machine, tuck stitches of the second yarn made in a previous pass of the carriage are transferred from the second needle bed to the first needle bed.

Clause 20: The method of manufacturing according to clause 19, wherein adjacent courses within the plurality of courses alternate between starting the second stitch sequence on a first needle on the second needle bed and starting the second stitch sequence on a second needle on the second needle bed.

Clause 21: The method of manufacturing according to any of clauses 19 to 20, wherein the first yarn forms at least part of a first surface of the knitted component and the second yarn forms at least part of a second surface of the knitted component, wherein when the knitted component is removed from the knitting machine, the third yarn forms a plurality of loops within each course within the plurality of courses, each loop extending outward from the second surface.

Clause 22: The method of manufacturing according to any of clauses 19 to 21, wherein the first yarn comprises a fusible yarn and forms at least a part of a first surface of the knitted component, wherein the method further includes applying heat to at least the part of the first surface to at least partially fuse the first yarn to the second yarn.

Clause 23: The method of manufacturing according to any of clauses 19 to 22, wherein the first stitch sequence consists of two knit stitches adjacent one missed stitch, and wherein the second stitch sequence consists of one tuck stitch adjacent two missed stitches.

Clause 24: The method of manufacturing according to any of clauses 19 to 23 further comprising forming the knitted component into an upper for an article of footwear.

Clause 25: A knitted component for an article, the knitted component comprising: a first surface and a second surface facing opposite the first surface; a plurality of courses comprising a first yarn and a second yarn; and a plurality of loops extending outward from the second surface, each loop being formed of a third yarn that is inlaid within the plurality of courses, wherein the first yarn has a first stitch sequence within each course of the plurality of courses, the first stitch sequence comprising a quantity of knit stitches and a quantity of missed stitches forming at least part of the first surface, wherein the second yarn has a second stitch sequence within each course of the plurality of courses, the second stitch sequence comprising a quantity of tuck stitches forming at least part of the second surface, each tuck stitch of the second yarn being looped with a knit stitch of the first yarn, wherein each of the first stitch sequence and the second stitch sequence is repeated at least once in each course of the plurality of courses.

Clause 26: The knitted component according to clause 25, wherein the plurality of loops are aligned in adjacent courses.

Clause 27: The knitted component according to clause 25 or 26, wherein the plurality of loops are aligned in a wale-wise direction in adjacent courses.

Clause 28: The knitted component according to clause 25, wherein the plurality of loops are offset in adjacent courses.

Clause 29: The knitted component according to clause 25 or 28, wherein the plurality of loops are offset in a wale-wise direction in adjacent courses.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and sub-combinations are of utility and may be employed without reference to other features and sub-combinations and are contemplated within the scope of the claims. Not all steps listed in the various figures need be carried out in the specific order described.

What is claimed is:

1. A knitted component for an article, the knitted component comprising:

a first surface and a second surface facing opposite the first surface;

a plurality of courses comprising a first yarn and a second yarn; and a plurality of loops extending outward from the second surface, each loop being formed of a third yarn that is inlaid within the plurality of courses, wherein the first yarn has a first stitch sequence within each course of the plurality of courses, the first stitch sequence comprising a quantity of knit stitches and a quantity of missed stitches forming at least part of the first surface, wherein the second yarn has a second stitch sequence within each course of the plurality of courses, the second stitch sequence comprising a quantity of tuck stitches forming at least part of the second surface, each tuck stitch of the second yarn being looped with a knit stitch of the first yarn, wherein each of the first stitch sequence and the second stitch sequence is repeated at least once in each course of the plurality of courses.

2. The knitted component of claim 1, wherein the first stitch sequence consists of two knit stitches adjacent one missed stitch.

3. The knitted component of claim 1, wherein the second stitch sequence consists of one tuck stitch adjacent two missed stitches.

4. The knitted component of claim 1, wherein, within each course of the plurality of courses, two adjacent missed stitches of the second yarn align within the same two wales as one knit stitch and one missed stitch of the first yarn.

5. The knitted component of claim 1, wherein the second stitch sequence of the second yarn is offset in adjacent courses.

6. The knitted component of claim 5, wherein the second stitch sequence of the second yarn is offset by one wale in adjacent courses.

7. The knitted component of claim 5, wherein the first stitch sequence of the first yarn is aligned across adjacent courses.

8. The knitted component of claim 1, wherein each loop of the third yarn is positioned between two tuck stitches of the second yarn.

9. An article of footwear comprising:

an upper comprising a knitted component, the knitted component comprising:

a first surface and a second surface facing opposite the first surface;

a plurality of courses comprising a first yarn and a second yarn; and a plurality of loops extending outward from the second surface, each loop being formed of a third yarn that is inlaid within the plurality of courses, wherein the first yarn has a first stitch sequence within each course of the plurality of courses, the first stitch sequence comprising a quantity of knit stitches and a quantity of missed stitches forming at least part of the first surface, wherein the second yarn has a second stitch sequence within each course of the plurality of courses, the second stitch sequence comprising a quantity of tuck stitches forming at least part of the second surface, each tuck stitch being looped with a knit stitch of the first yarn, wherein each of the first stitch sequence and the second stitch sequence is repeated at least once in each course of the plurality of courses.

10. The article of footwear of claim 9, wherein the first stitch sequence consists of two knit stitches adjacent one missed stitch, and the second stitch sequence consists of one tuck stitch adjacent two missed stitches.

11. The article of footwear of claim 9, wherein the plurality of courses comprises a plurality of adjacent courses.

12. The article of footwear of claim 9, wherein the second surface forms at least part of an interior surface of the upper.

13. The article of footwear of claim 9, wherein the first yarn comprises a fusible yarn that is at least partially fused with the second yarn.

14. The article of footwear of claim 13, wherein the first yarn has a first melting temperature and the third yarn has a third temperature that is greater than the first melting temperature, wherein the third temperature is the lower of a melting temperature or a decomposition temperature of the third yarn.

15. The article of footwear of claim 9, wherein the plurality of loops formed by the third yarn are positioned in a first area of the knitted component, wherein a second area of the knitted component is integrally knitted with the first area and does not include loops extending outward from the second surface.

16. A method of manufacturing a knitted component, the method comprising:

knitting a plurality of courses with a first yarn and a second yarn; and inlaying a third yarn between the first yarn and the second yarn within each course within the plurality of courses, wherein each course within the plurality of courses is knit by:

knitting the first yarn on a first needle bed of a knitting machine using a first stitch sequence, the first stitch sequence being repeated at least once and including a quantity of knit stitches and a quantity of missed stitches, and knitting the second yarn on a second needle bed of the knitting machine using a second stitch sequence, the second stitch sequence being repeated at least once and including a quantity of tuck stitches and a quantity of missed stitches, wherein, as the third yarn is inlaid in a pass of a carriage on the knitting machine, tuck stitches of the second yarn made in a previous pass of the carriage are transferred from the second needle bed to the first needle bed.

17. The method of manufacturing the knitted component of claim 16, wherein adjacent courses within the plurality of courses alternate between starting the second stitch sequence on a first needle on the second needle bed and starting the second stitch sequence on a second needle on the second needle bed.

18. The method of manufacturing the knitted component of claim 16, wherein the first yarn forms at least part of a first surface of the knitted component and the second yarn forms at least part of a second surface of the knitted component, wherein when the knitted component is removed from the knitting machine, the third yarn forms a plurality of loops within each course within the plurality of courses, each loop extending outward from the second surface.

19. The method of manufacturing the knitted component of claim 16, wherein the first yarn comprises a fusible yarn and forms at least a part of a first surface of the knitted component, wherein the method further includes applying heat to at least the part of the first surface to at least partially fuse the first yarn to the second yarn.

20. The method of manufacturing the knitted component of claim 16, wherein the first stitch sequence consists of two knit stitches adjacent one missed stitch, and wherein the second stitch sequence consists of one tuck stitch adjacent two missed stitches.

* * * * *